US006349527B1

(12) United States Patent
Keppick

(10) Patent No.: US 6,349,527 B1
(45) Date of Patent: Feb. 26, 2002

(54) EQUESTRAIN TRAINING DEVICE

(76) Inventor: Kim Keppick, P.O. Box 1268, Middleburg, VA (US) 20118

( * ) Notice: Subject to any disclaimer, the term of this patent is extended or adjusted under 35 U.S.C. 154(b) by 0 days.

(21) Appl. No.: 09/575,622

(22) Filed: May 22, 2000

Related U.S. Application Data

(63) Continuation-in-part of application No. 09/150,372, filed on Sep. 10, 1998, now Pat. No. 6,085,500.

(51) Int. Cl.[7] ..... B68B 1/04
(52) U.S. Cl. ..... 54/71; 119/768; 54/36
(58) Field of Search ..... 54/71, 7, 8, 9, 54/36; 119/768, 712, 798

(56) References Cited

U.S. PATENT DOCUMENTS

| | | | | | |
|---|---|---|---|---|---|
| 68,569 | A | * | 9/1867 | Miller | |
| 122,491 | A | * | 1/1872 | Robbins | |
| 136,256 | A | * | 2/1873 | Nealey, Jr. et al. | |
| 312,330 | A | * | 2/1885 | Champlain et al. | |
| 424,258 | A | * | 3/1890 | Belknap | |
| 2,737,154 | A | * | 3/1956 | Michonski | |
| 4,459,795 | A | * | 7/1984 | Le Tixerant | 54/6 |
| 4,965,987 | A | * | 10/1990 | Bork | 54/7 |
| 5,079,904 | A | * | 1/1992 | Berube | 54/6 |
| 5,148,656 | A | * | 9/1992 | Meahgan | 54/36 |
| 5,231,818 | A | * | 8/1993 | Newman | 54/71 |
| 5,442,900 | A | * | 8/1995 | Ciampi | 54/71 |
| 5,873,328 | A | * | 2/1999 | Campbell | 119/798 |
| 6,148,592 | A | * | 11/2000 | Schneider | 54/36 |

FOREIGN PATENT DOCUMENTS

| | | | |
|---|---|---|---|
| FR | 2615-846 | A | * 2/1988 |
| GB | 117116 | A | * 7/1918 |
| GB | 426081 | A | * 3/1935 |

* cited by examiner

*Primary Examiner*—Michael J. Carone
*Assistant Examiner*—Yvonne R. Abbott
(74) *Attorney, Agent, or Firm*—Jones, Tullar & Cooper, P.C.

(57) ABSTRACT

An equestrian rider training rein,the training device having an elastic portion in each rein between the bit and the rider's end of the reins. The elastic portion of the device trains the new rider in applying the proper pressure on the reins in order to closely control the mount while not applying excessive pressure which may irritate or injure the mount and make delicate control more difficult. In a second embodiment the elastic portion is backed by an inelastic portion of the rein which is of greater length than the unextended elastic portion so that if greater pressure is required to control the mount, as in the case of a runaway mount, the rider may apply direct pressure to the bit for emergency control.

6 Claims, 7 Drawing Sheets

EQUESTRAIN TRAINING DEVICE

This application is a continuation-in-part of U.S. patent application Ser. No. 09/150,372, filed Sep. 10, 1998, now U.S. Pat. No. 6,085,500.

BACKGROUND OF THE INVENTION

This invention relates in general to devices for training an equestrian and in particular for training an equestrian in attaining the skills necessary to control the movements of the mount in all respects with the least effort for the rider and the least discomfort to the mount while retaining sufficient control to handle emergency conditions. These skills are necessary in order for riders to achieve basic proficiency in their riding so that they are confident that they can easily maintain their balance and posture while precisely controlling the speed and direction of their mount. Riders not only want to get from A to B but want to carefully control and influence the manner in which they get there. In the journey from A to B the rider strives to enhance the beauty of the mount by improving his balance, suppleness and understanding of the rider's signals. The mount must understand not only the direction to turn, for example, but must also understand how much the rider wants him to bend his body and stretch his back; how high to lift his legs and precisely where to put them down during the course of the turn.

To achieve this result requires close communication between the mount and rider through the use of the rider's legs and torso, (the seat) and more importantly, the contact between the rider's hands and the mouth of the mount. If this contact is too loose, the connection between mount and rider is ineffective and fine control is lost. However, if the connection is too tight, that is, the reining control force is too high, the force of the bit can injure the mount's mouth, which is of very sensitive tissue, and the discomfort caused to the mount can interfere with a smooth and beautiful performance by the mount and rider. An irritated mount can understandably become "uncooperative" and detrimentally effect the performance.

Beginning riders tend to apply rein tensions higher than necessary and tend to apply reining force in a jerky manner thus effecting the mount's response and cooperation. To apply just the right rein tension requires the development of a "feel" in the hands of the rider so that the rider can communicate his desired instructions to the mount and maintain a good relationship with the mount.

SUMMARY OF THE INVENTION

The present invention overcomes the disadvantages discussed above by providing a training system which will allow a rider to develop the ability to apply and maintain the proper tension in the reins without becoming rigid in his posture and will allow him to concentrate on learning to use the shoulders and elbows to create the "feel" for a proper riding style.

This invention provides a rein having a body of inelastic material with an elastic member inserted in the body of the rein at each the end of the rein which attaches to the bit. This elastic member allows the rider to attain proper techniques without injuring the mount while learning to sense the communicative touch necessary to join the mount and rider into a team of performers who understand each other and communicate their understandings easily and consistently. While the device of this invention provides a soft rein for the rider, a second embodiment allows a stronger control force when required such as in the case of a run-away mount.

DETAILED DESCRIPTION OF THE PREFERRED EMBODIMENT

Figure 1:
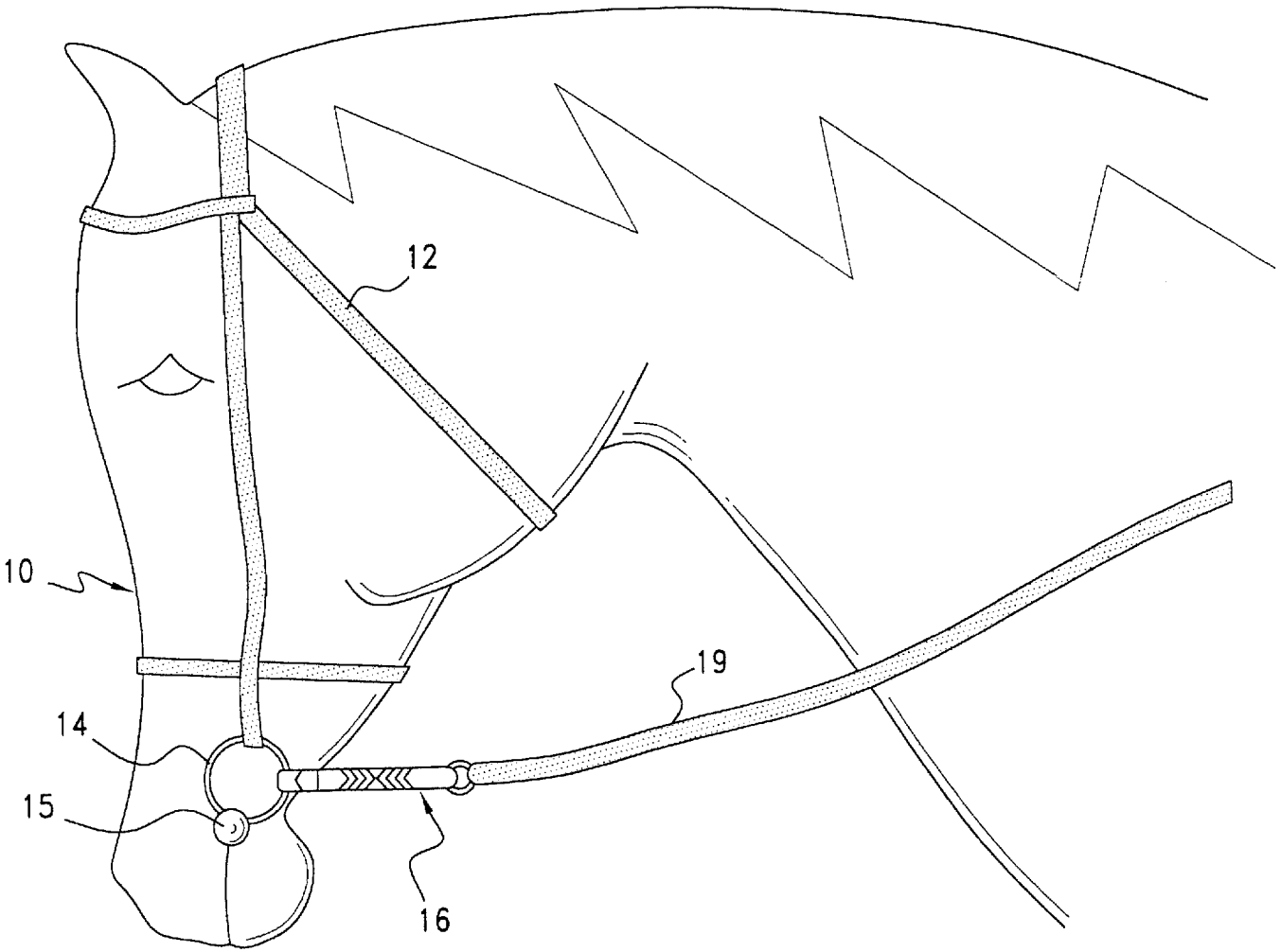
FIG. 1 is a side view of a horse wearing a bridle with the training device incorporated in the reins of the bridle.

Referring now to FIG. 1, there is shown the head of a horse 10 wearing a bridle 12 of known design and having the invention of this application incorporated in the reins of the bridle and shown generally at 16. The bridle includes a bit 15 attached to the bridle through a ring 14. This is an illustration of a simple form of bridle. However, it is understood that the invention of this application may be used in the same manner with bridles and bits of other varied configurations.

Figure 2:
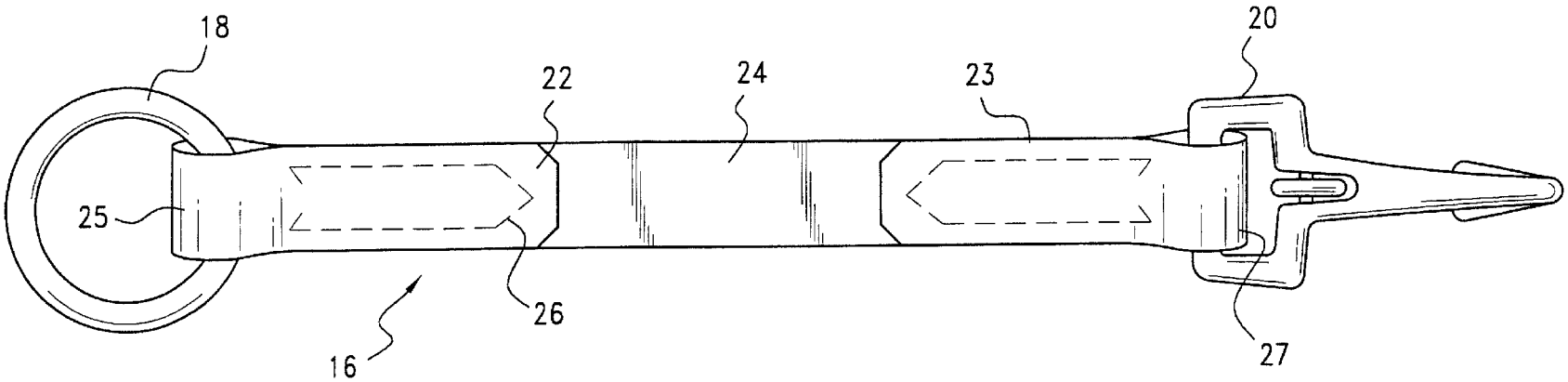
FIG. 2 illustrates a first embodiment of the training device.

FIG. 2 illustrates one embodiment of the training device. The training device consists of a strap assembly 16 to be incorporated into the reins 18 of a bridle. The reins 18 include an inelastic body and an elastic strap at each end. The strap consists of end members 22 and 23 which are made of a substantially inelastic material. This portion of the strap would traditionally be made of leather of approximately ⅝ inch width. Connecting the two inelastic ends of the strap is an elastic portion 24. This portion of the strap, which is the approximately same width as the leather ends, may be made of any elastic material having appropriate stretch or elongation properties. The end members 22 and 23 are formed into loops 25 and 27 respectively. Loop 25 encloses a portion of ring 18 which provides a means of attachment to the rein of the bridle. Loop 27, in this embodiment, secures a snap 20 for attaching the strap to the bit. Details of these properties of the elastic material will be discussed in more detail below.

Figure 3A:
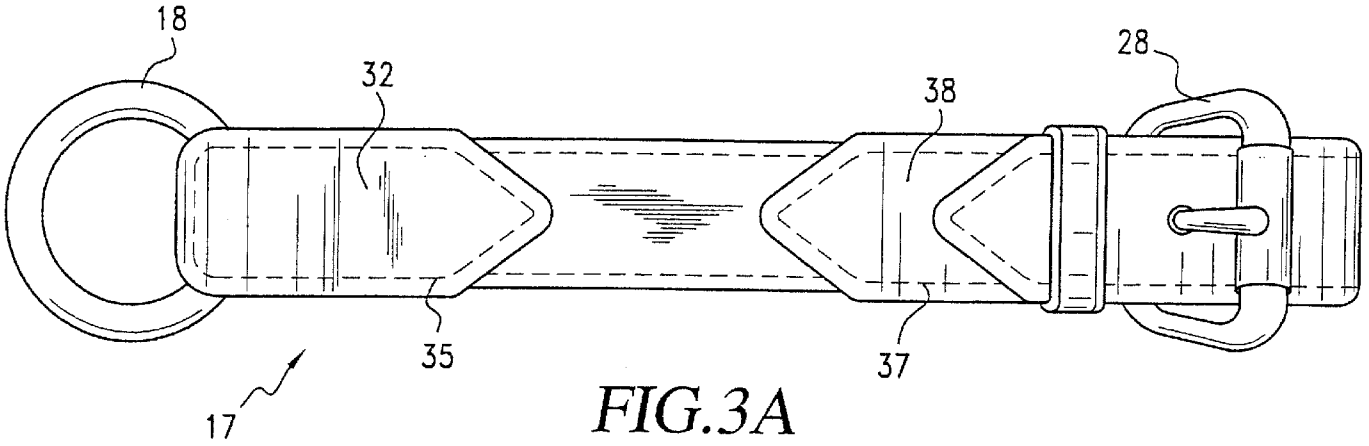
FIGS. 3A and 3B illustrate a plan view and a side view, respectively of a second embodiment of the training device.
Figure 3B:
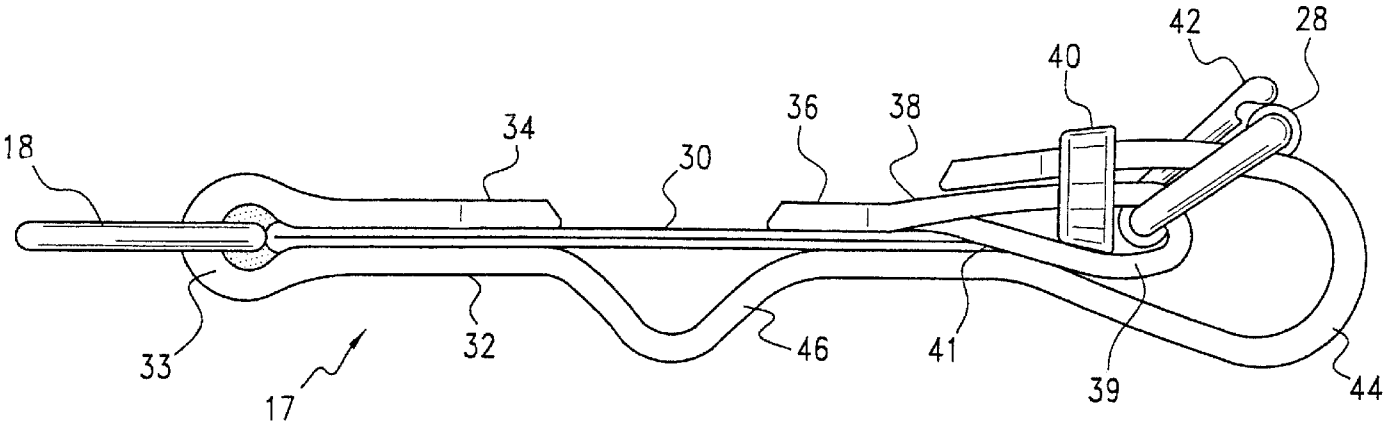

Referring now to FIGS. 3A and 3B, there is illustrated another embodiment of the training device. The strap assembly 17 is similar to the strap 16 of FIG. 2, having a ling 18 for attachment of the strap to the rein 19 of the bridle 12. Here again the strap is formed of two inelastic members and an elastic member in a manner which allows the strap to elongate within preset limits. In this embodiment, the end piece 32 is formed in a loop 33 around the ring 18. An elastic member 30 is inserted between the layers of the piece 32 which form the loop 33. The piece 32 and the elastic member 30 are fastened together at 34 to form a three layer end assembly. The fastening means may be of any known type. Traditionally, the end piece 32 and the elastic member 30 would be sewn together as shown at 35. A second end piece 38 is formed in a loop 39 around a buckle 28 and also fastened to the elastic member 30. Here, the end piece 32 and the end piece 38 are attached on opposite ends of the elastic member 30 to form a second three layer end assembly. The tail end 41 of the end piece 38 is tucked between the end piece 32 and the outer portion of the end piece 38 and is attached to both end pieces. The means for attaching the end piece to the elastic member 30 could again be of any known type of fastening means. However in the illustrated embodiment the layers of the end assembly are shown sewn together by stitching 37 which gives the assembly a look traditionally associated with equestrian tack.

The end piece 32 then is formed into a loop 44 for attachment to the bit 15 of the bridle 12. This loop is secured by passing the loop end 44 of the end piece 32 through the buckle 28 and inserting the tang 42 of the buckle 28 into a hole provided in the end piece 32 in the usual manner. The tail end of the end piece 32 is then retained by a loop 40.

The feature of this embodiment is the loop 46 formed in the end piece 32 opposite the elastic member 30. This loop allows the elastic member 30 to stretch until the loop 46 has been straightened. At this point, the strap assembly acts as a solid strap connecting the rein to the bit. In this condition, the rider can exert as much force on the rein as may be needed to control the horse in case of an emergency condition.

The selection of the appropriate elastic material for use in this invention is critical. The fabric can be woven, braided or knitted. The material to be used in this invention must be selected according to the percent of "stretch" the material provides as well as its appearance and weight. The "stretch" is expressed as the percent of the unstretched length of the elastic member by which the member may be lengthened when the member is at its maximum stretched length. For example, a 10 inch elastic member which can be stretched one inch will have a stretch of 10 percent. A wide range of materials has been tested ranging from 20 percent stretch to 120 percent stretch. These tests showed that a stretch of between 50 percent and 70 percent appears to provide the most beneficial feel with the horses tested. It would be appropriate to have several of these strap assemblies available, each having an elastic member of different amounts of stretch in order to provide the best feel depending on the horse-rider combination being trained. That is, the stretch provided for one rider may not be appropriate for another rider having different a different style or a different level of riding experience. In general, the width of the strap is ⅝ inch which is the same width as a standard rein. It is desirable to have the strap assembly a short as practical to keep the rein light and of a convenient length.

Figure 4:
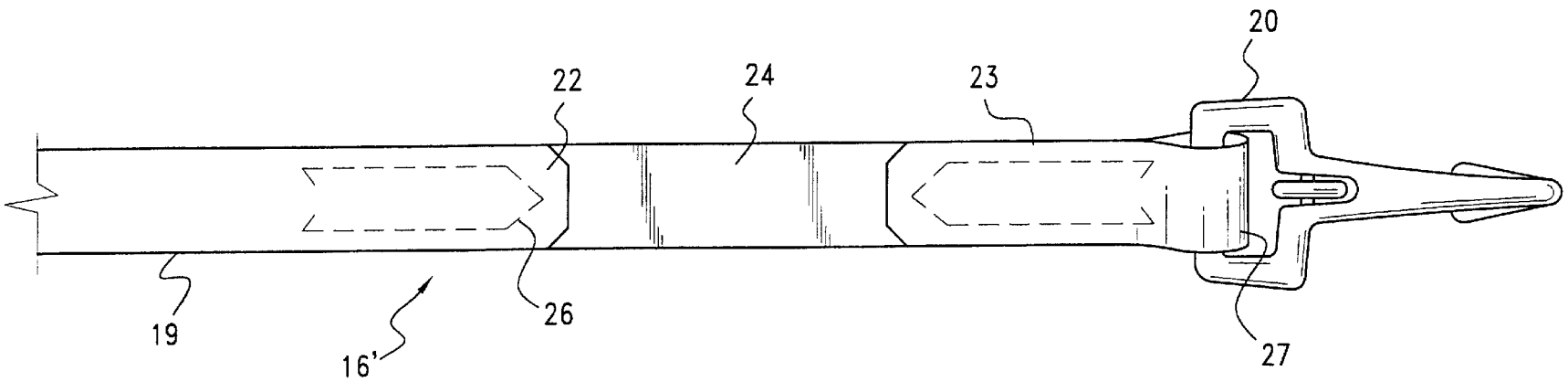
FIG. 4 illustrates a first embodiment of the invention in which the elastic member is incorporated as a part of the rein assembly.
Figure 5A:
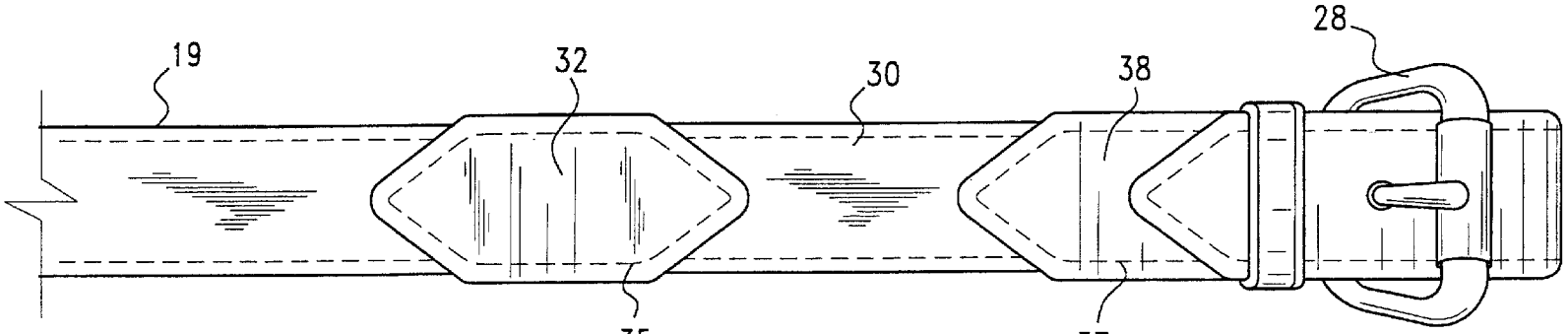
FIG. 5A illustrates a plan view of a second embodiment of the invention having the elastic member incorporated as part of the rein.
Figure 5B:
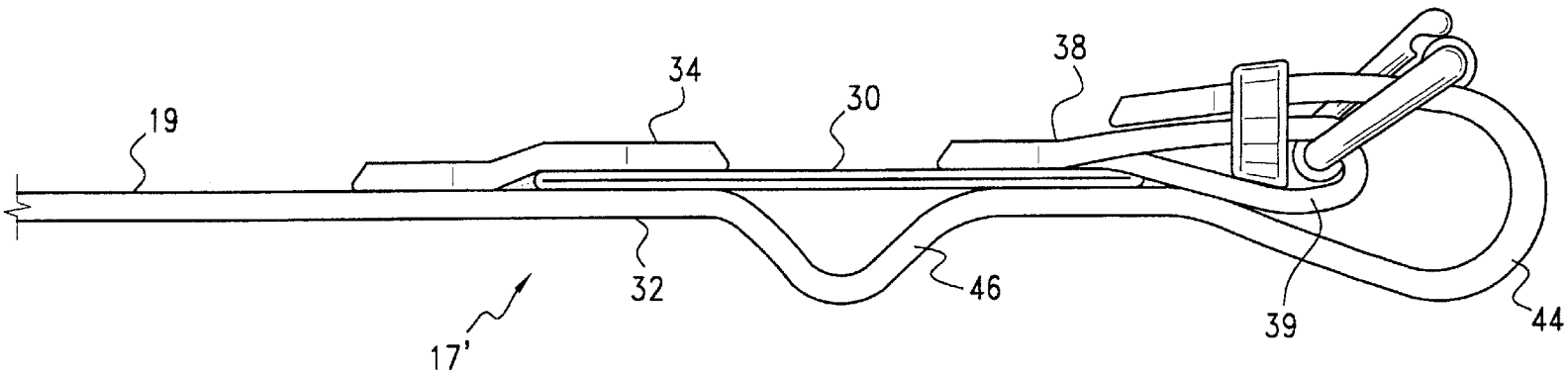
FIG. 5B is a side view of the embodiment of FIG. 5A.
Figure 6:
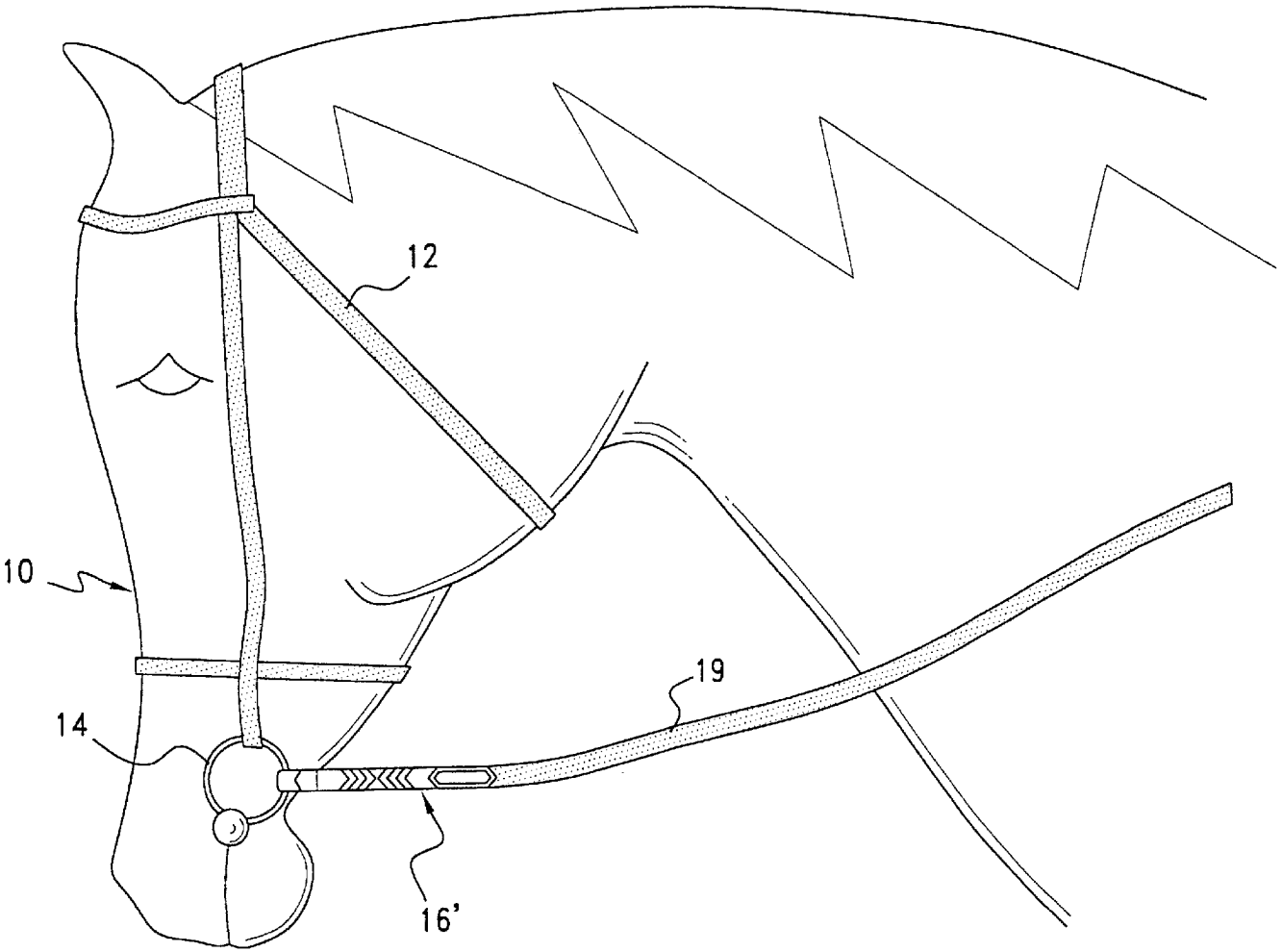
FIG. 6 is an overall view of the embodiment of FIG. 4.
Figure 7:
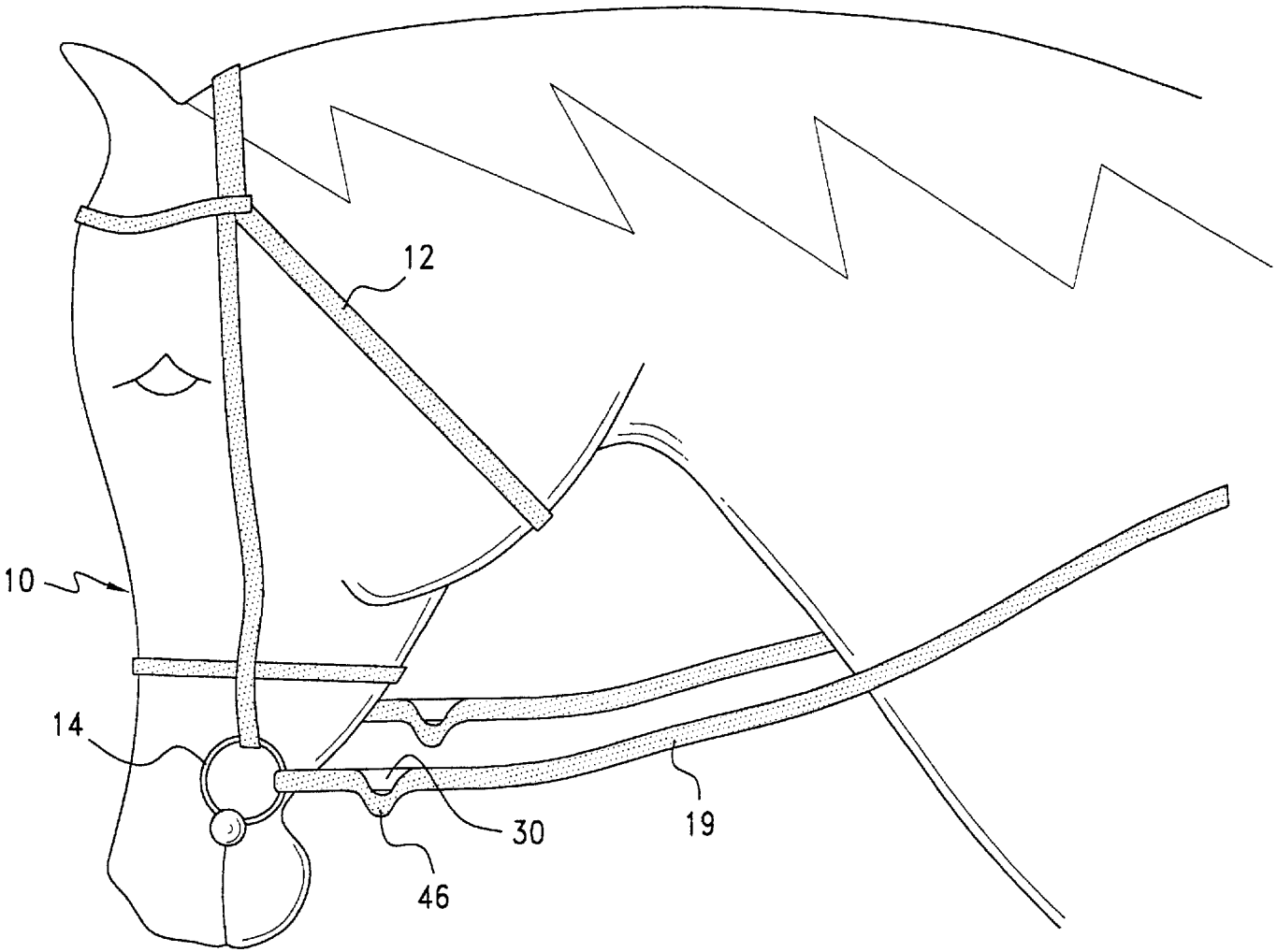
FIG. 7 is an overall view of the embodiment of FIGS. 5A and 5B.

In FIG. 4, there is illustrated the basic structure of the embodiment of the invention discussed in connection with FIG. 2 above. However, in this embodiment, the attaching ring 18 has been eliminated and the elastic member 24 has bee sewn directly to one end of the body of the rein 19 forming a one piece elastic rein. FIGS. 5A and 5B illustrate another embodiment which incorporates the basic structure of the embodiment of FIGS. 3A and 3B but having the attachment ting 18 eliminated and the elastic member 30 sewn directly to the body of the rein 19 and forming the loop 46 as shown in FIG. 3B forming a second embodoment of a one piece elastic rein. FIG. 6 shows an overall view of the embodiment of FIG. 4. FIG. 7 illustrates the embodiment of FIGS. 5A and 5B showing the loop 46 created in the rein body by the means of attaching the elastic members 30 at their ends along the rein body. The attachment points of the elastic members 30 being separated on the rein body a distance greater than the unstretched length of the elastic members.

As can be seen from the above description, there is provided by this invention a valuable piece of equipment, tailored to a particular horse or horse and rider combination, which will enable the rider to develop an appropriate "feel" for the proper tension to apply to the rein which will give the best control of the horse while keeping the horse in a cooperative mood without causing injury to the horses mouth yet allow the rider to retain total control in the event of an emergency such as a runaway horse.

What is claimed is:

1. An equestrian rider training rein for connecting to a bridle assembly, said bridle including a bit for insertion in the mouth of the mount to be ridden, said bit having first and second ends extending from the respective sides of the mount's mouth and having first and second rein-attaching means on the respective ends of said bit, said training rein comprising:

a rein body of inelastic material and having first and second ends;

a first elastic member having first and second ends, said first end of said elastic member being fixed to said first end of said rein body;

a second elastic member having first and second ends, said first end of said second elastic member being fixed to said second end of said rein body; and first and second attachment means connected to said second ends of said respective first and second elastic members for attaching said rein body and said first and second elastic members to respective first and second ends of said bit.

2. The training rein according to claim 1 wherein said attachment means are buckles connected to the second ends of said first and second elastic means for connecting said rein to said rein attaching means of said bit.

3. The training rein according to claim 1 wherein said attachment means are snaps connected to the second ends of said first and second elastic means for connecting said rein to said rein attaching means of said bit.

4. An equestrian rider training rein for connecting to a bridle assembly, said bridle including a bit for insertion in the mouth of the mount to be ridden, said bit having first and second ends extending from the respective sides of the mount's mouth and having first and second rein-attaching means on the respective ends of said bit, said training rein comprising:

a rein body of inelastic material and having first and second ends;

attachment means on the first and second ends of said rein body for attaching said rein body to respective ends of said bit; and first and second elastic members of a specified length, each fastened at each end thereof to said rein body, along the length of said rein body near the respective first and second ends thereof, said first and second elastic members having an unstretched length, said unstretched length of said elastic members being less than the distance between the attachment points of said elastic members on said rein body thereby forming a loop in the rein body when the elastic members are in the unstretched condition.

5. The training rein according to claim 4 wherein said attachment means are buckles connected to the first and second ends said rein for attaching said rein to said bit attaching means.

6. The training rein according to claim 4 wherein said attachment means are snaps connected to the first and second ends of said reins for attaching said rein to said bit attaching means.

* * * * *